US008359768B2

(12) United States Patent
Cheng

(10) Patent No.: US 8,359,768 B2
(45) Date of Patent: Jan. 29, 2013

(54) AIR INLET AND OUTLET PASSAGE MODULE FOR DESICCATION

(76) Inventor: Tsan-Hsiung Cheng, Tainan County (TW)

( * ) Notice: Subject to any disclaimer, the term of this patent is extended or adjusted under 35 U.S.C. 154(b) by 438 days.

(21) Appl. No.: 12/816,031

(22) Filed: Jun. 15, 2010

(65) Prior Publication Data

US 2011/0302800 A1 Dec. 15, 2011

(51) Int. Cl.
*F26B 25/06* (2006.01)

(52) U.S. Cl. ..... 34/174; 34/232; 34/90; 34/242; 165/104.26; 165/104.21; 62/259.3; 96/17; 454/184

(58) Field of Classification Search ..... 34/60, 78, 34/80, 90, 413, 174, 232, 242; 165/104.26, 165/104.21; 96/17; 454/184
See application file for complete search history.

(56) References Cited

U.S. PATENT DOCUMENTS

| | | | | |
|---|---|---|---|---|
| 3,766,844 | A * | 10/1973 | Donnelly et al. | 454/238 |
| 4,382,849 | A * | 5/1983 | Spicer | 204/258 |
| RE32,554 | E * | 12/1987 | Murphy | 244/118.5 |
| 4,974,915 | A * | 12/1990 | Bussard | 312/236 |
| 5,005,523 | A * | 4/1991 | Foster | 119/319 |
| 5,261,781 | A * | 11/1993 | Bandy | 414/791.6 |
| 5,735,318 | A * | 4/1998 | Vianello | 141/67 |
| 5,802,735 | A * | 9/1998 | Schoonhoven | 34/174 |
| 5,906,677 | A * | 5/1999 | Dudley | 96/17 |
| 6,241,794 | B1 * | 6/2001 | Jadran et al. | 55/490 |
| 6,578,319 | B1 * | 6/2003 | Cole et al. | 47/61 |
| 7,862,410 | B2 * | 1/2011 | McMahan et al. | 454/184 |
| 8,087,254 | B2 * | 1/2012 | Arnold | 62/3.5 |
| 2005/0155248 | A1 * | 7/2005 | Silverbrook et al. | 34/422 |
| 2005/0193537 | A1 * | 9/2005 | Berner et al. | 29/25 |
| 2008/0029081 | A1 * | 2/2008 | Gagas et al. | 126/299 D |
| 2008/0141681 | A1 * | 6/2008 | Arnold | 62/3.5 |
| 2011/0147194 | A1 * | 6/2011 | Kamen et al. | 202/185.1 |
| 2011/0239680 | A1 * | 10/2011 | Dechene et al. | 62/259.2 |
| 2011/0277967 | A1 * | 11/2011 | Fried et al. | 165/104.26 |
| 2011/0302800 | A1 * | 12/2011 | Cheng | 34/232 |
| 2012/0180992 | A1 * | 7/2012 | Koplow | 165/104.21 |
| 2012/0227432 | A1 * | 9/2012 | Creech et al. | 62/259.3 |
| 2012/0263988 | A1 * | 10/2012 | Obasih et al. | 429/98 |

FOREIGN PATENT DOCUMENTS

| | | | |
|---|---|---|---|
| FR | 2777825 | A1 * | 10/1999 |
| GB | 2204675 | A * | 11/1988 |
| JP | 02286897 | A * | 11/1990 |

* cited by examiner

*Primary Examiner* — Stephen M. Gravini
(74) *Attorney, Agent, or Firm* — Muncy, Geissler, Olds & Lowe, PLLC

(57) ABSTRACT

An air inlet and outlet passage module for desiccation is formed in a hollow structure including a frame and two boards. The frame has a frame channel formed between frame sides and a duct cap on an outer side. The duct cap has an opening communicating with the frame channel and is coupled with an air duct to connect a plurality of air inlet and outlet passage modules in series. The duct cap not being coupled is sealed through a lid. The two boards are located at two corresponding sides of the frame and have a plurality of air vents formed thereon to facilitate air ventilation. Each air vent is formed at a diameter smaller than that of a grain to prevent crops from dropping into the module. The invention can be assembled and disassembled, and coupled in series or parallel easily to enhance drying efficiency and reduce energy waste.

8 Claims, 16 Drawing Sheets

AIR INLET AND OUTLET PASSAGE MODULE FOR DESICCATION

FIELD OF THE INVENTION

The present invention relates to an air inlet and outlet passage module for desiccation and particularly to a hollow structure formed with air vents to dry crops.

BACKGROUND OF THE INVENTION

The traditional agricultural society generally adopts sunshine drying to desiccate crops. The harvested crops usually are spread on the road under sunshine for drying, and have to be tumbled frequently by labor power to move the dried crops at the upper side to the bottom. It takes a prolonged period of sunshine, tumbling and wind blowing to dry the crops for preservation.

However, in undesirable environments such as damp or raining weather, or a drying site is difficult to get, or time is urgent for transportation or storage, the crops are easily damped and damaged. Moreover, tumbling grains manually requires a great deal of manpower, and people working in such an environment is easily suffered from heatstroke or sunburn, and the dried crops still need manpower to put them into sacks, transport and store. It leaves a lot to be desired.

With advance of technology, drying systems dedicated for crops have been developed and available on the market. They generally are held in a storage tank. Dry air enters the storage tank from the bottom and damp is expelled from the top of the storage tank. Air is circulated in such a fashion to dry the crops. But in such a drying approach, moisture in the crops is conveyed upwards layer by layer from the bottom of the storage tank to the top, and the moving distance is lengthy and a longer time is needed. Moreover, the crops piled in the storage tank are thicker than the layer adopting the traditional sunshine drying approach, the moisture expelled from the bottom tends to be absorbed by the upper crops before moving to the top. Hence drying effect suffers and energy waste occurs. There is still room for improvement.

SUMMARY OF THE INVENTION

Therefore, the primary object of the present invention is to solve the shortcomings of the conventional crops drying equipment by providing an improved air inlet and outlet passage module for desiccation.

To achieve the foregoing object, the air inlet and outlet passage module according to the invention includes a hollow structure with air vents formed thereon, and can be deployed individually or coupled in multiple to form an air inlet and an air outlet so that crops can be dried in a physical condition like sunshine drying in a shorter period at an enhanced efficiency, and also can reduce energy waste.

The module according to the invention provides many benefits, notably:

1. Dry air enters through a dry air inlet and is evenly spread to a storage space storing the crops through the hollow structure with the air vents formed thereon. Airflow circulation speed is enhanced and damp can be expelled rapidly through a damp air outlet.

2. The distance between the air inlet and air outlet can be set according to actual requirement to improve drying efficiency.

3. Assembly of the module is simpler and adaptable to all types of storage equipment, such as small and fixed tanks, movable loading vehicles or international bulk carriers, hence applicability is higher.

4. Drying effect can be enhanced by adding modules without altering the original storage equipment. Thus no huge extra installation cost incurs.

5. The module can be designed and produced in a modular fashion according to sites and equipment sizes in different specifications to meet varying market requirements, hence practicability and usability are higher.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
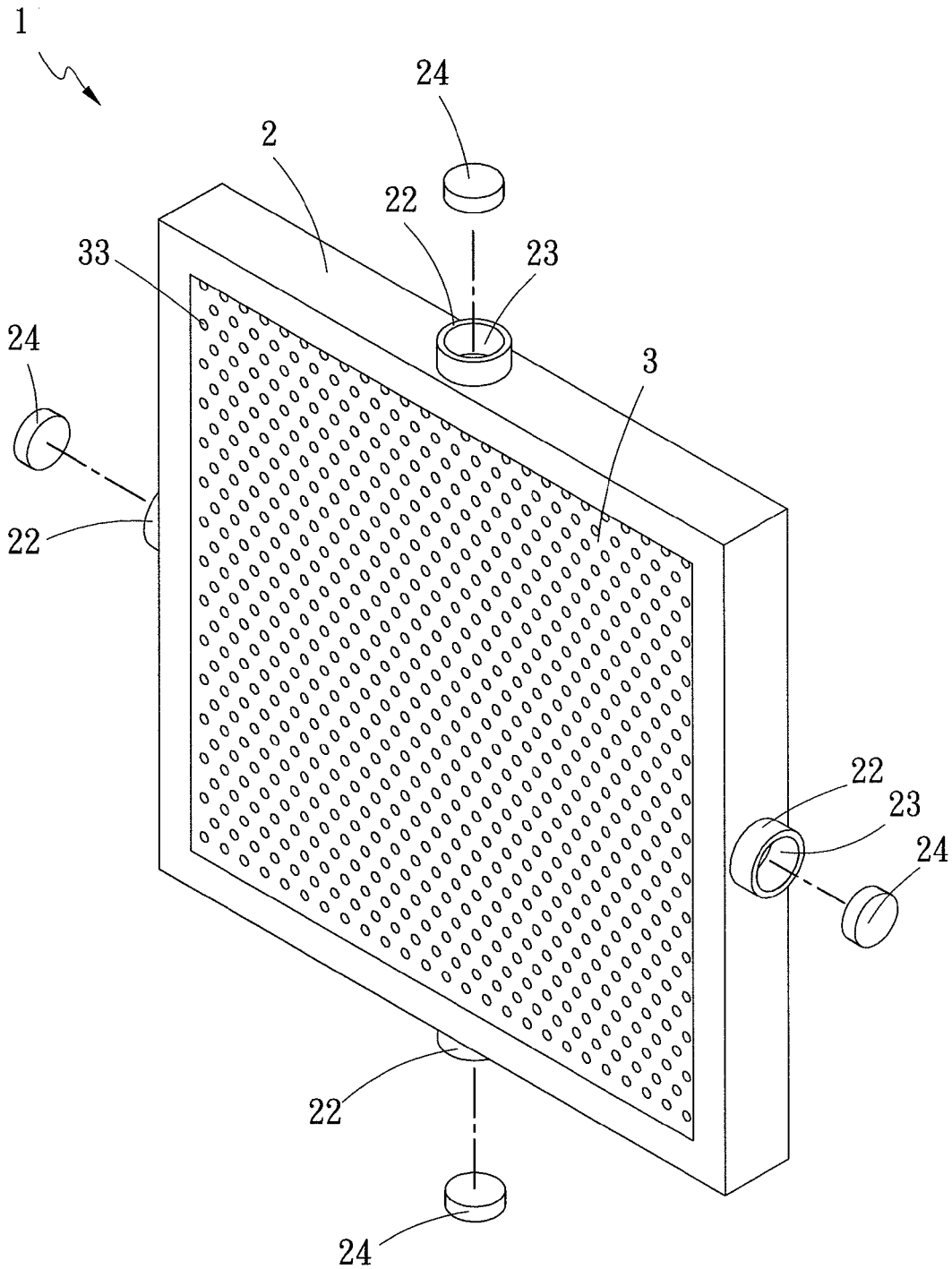
FIG. 1 is a perspective view of the invention.

Please refer to FIGS. 1 through 7, the present invention provides an air inlet and outlet passage module 1 for desiccation that is a cubical hollow structure including a frame 2 and two boards 3.

The frame 2 is made of metal and has a frame channel 21 formed between frame sides thereof and at least one duct cap 22 on an outer side with an opening 23 communicating with the frame channel 21. The duct cap 22 is coupled with an air duct (referring to FIGS. 11 through 13) such that a plurality of air inlet and outlet passage modules 1 can be coupled in series through the air duct. Coupling of the air duct and the air inlet and outlet passage module 1 may be done by wedging, latching or connecting through a connector 211 (as shown in FIG. 13) to form a serial or parallel connection to enhance drying efficiency. The duct cap 22 on the outer side of the frame 2 without being coupled may be sealed through a lid 24.

The two boards 3 are located at two sides of the frame 2 corresponding to each other to form the hollow structure with a housing space 31 inside to hold at least one reinforced member 32. In this embodiment, the reinforced members 32 are located on inner walls of the two boards 3 in a cross manner to enhance strength and sturdiness to prevent deformation caused by squeezing when crops are stored and piled inside. Each of the two boards 3 has a plurality of air vents 33 for air flowing. Each of the air vents 33 is formed at a diameter smaller than that of a grain to prevent the crops from dropping into the housing space 31.

Figure 8:
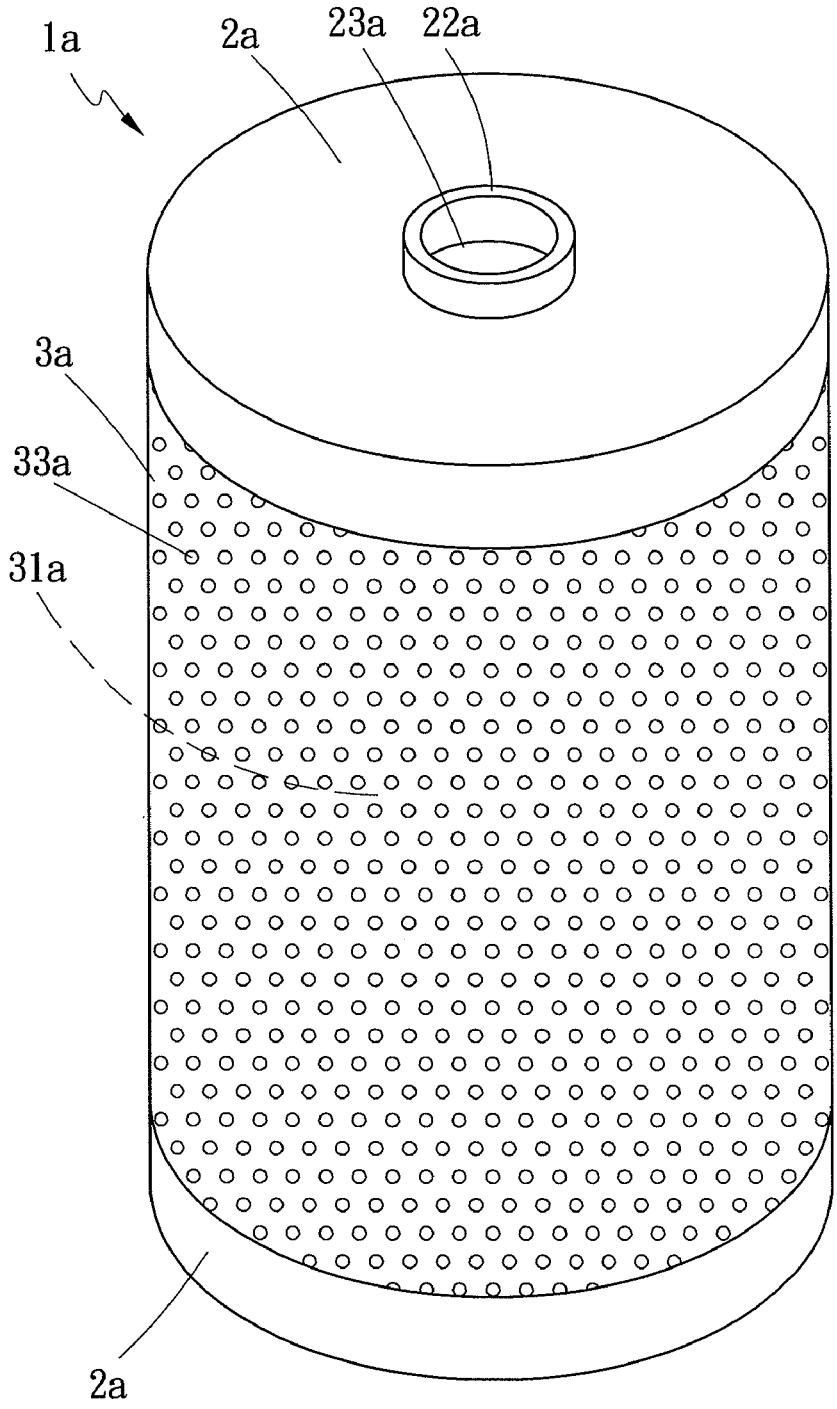
FIG. 8 is a perspective view of another embodiment of the invention.
Figure 9:
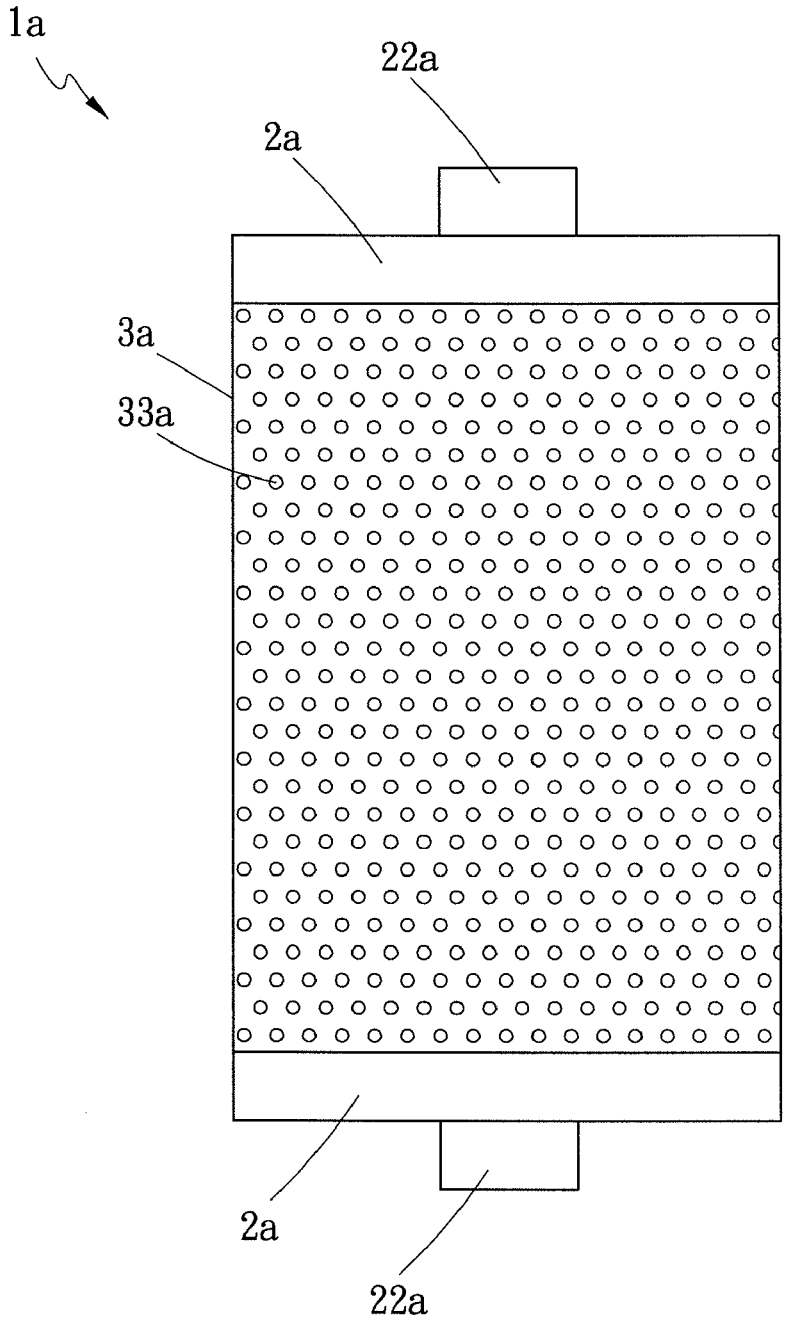
FIG. 9 is a front view according to FIG. 8.
Figure 10:
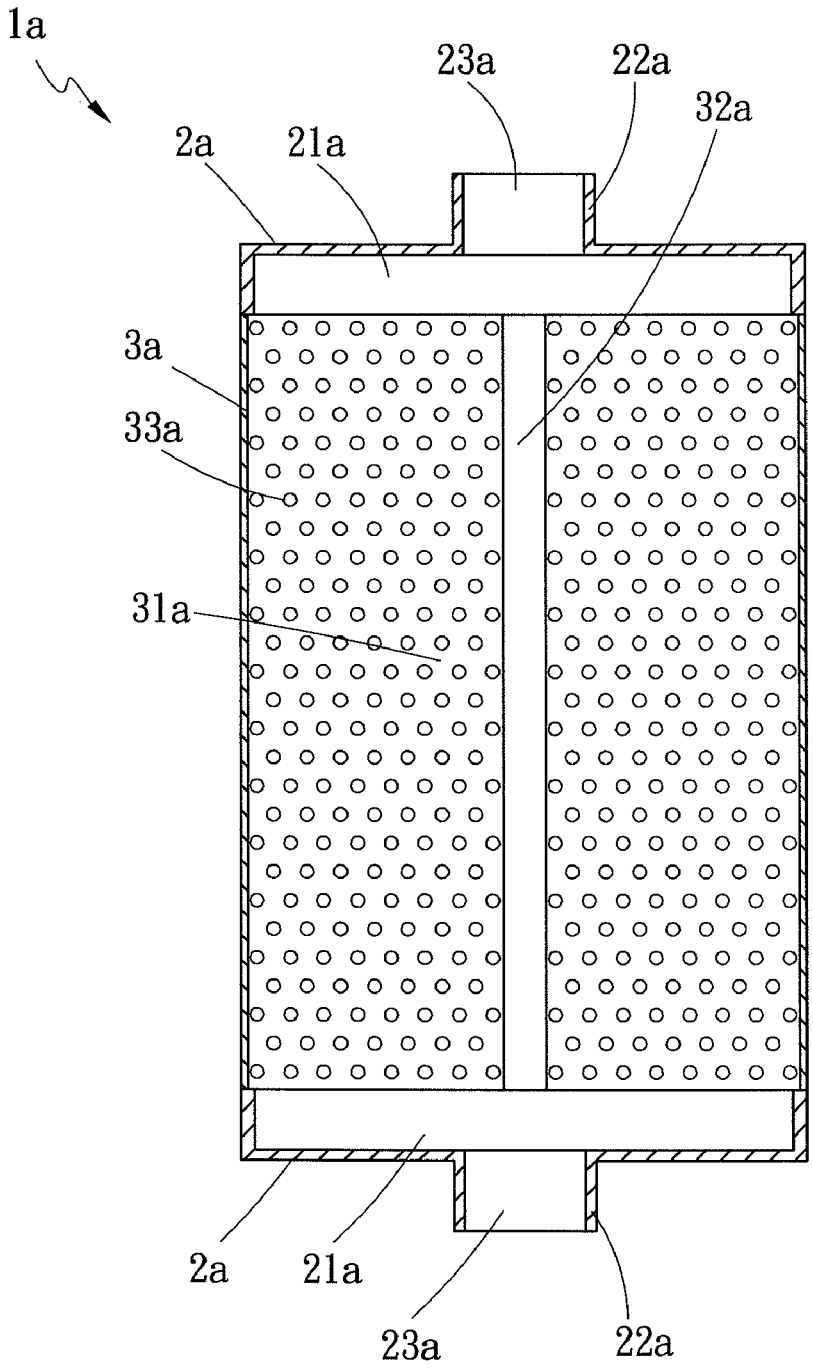
FIG. 10 is a front sectional view according to FIG. 8.

Refer to FIGS. 8 through 10 for another embodiment of the invention. The air inlet and outlet passage module 1*a* is a cylindrical hollow structure including two frames 2*a* and a board 3*a*.

The two frames 2*a* have respectively a frame channel 21*a* formed on an inner rim thereof and at least one duct cap 22*a* formed on an outer side. The duct cap 22*a* has an opening 23*a* communicating with the frame channel 21*a*. The duct cap 22*a* is coupled with an air duct (referring to FIGS. 11 through 13) such that a plurality of air inlet and outlet passage modules la can be coupled in series through the air duct. The coupling may be formed in a serial or parallel manner as previously discussed. The duct cap 22*a* on the outer side of the frame 2*a* without being coupled may be sealed through a lid 24 (as shown in FIG. 1).

The board 3*a* bridges the two frames 2*a* in an annular manner to form the hollow structure with a housing space 31*a* inside to hold at least one reinforced member 32*a*. The reinforced member 32*a* is held on an inner wall of the board 3*a* to prevent deformation caused by squeezing when crops are stored and piled inside. The board 3*a* has a plurality of air vents 33*a* for air flowing. Each of the air vents 33*a* is formed at a diameter smaller than that of a grain to prevent the crops from dropping into the housing space 31*a*.

Figure 11:
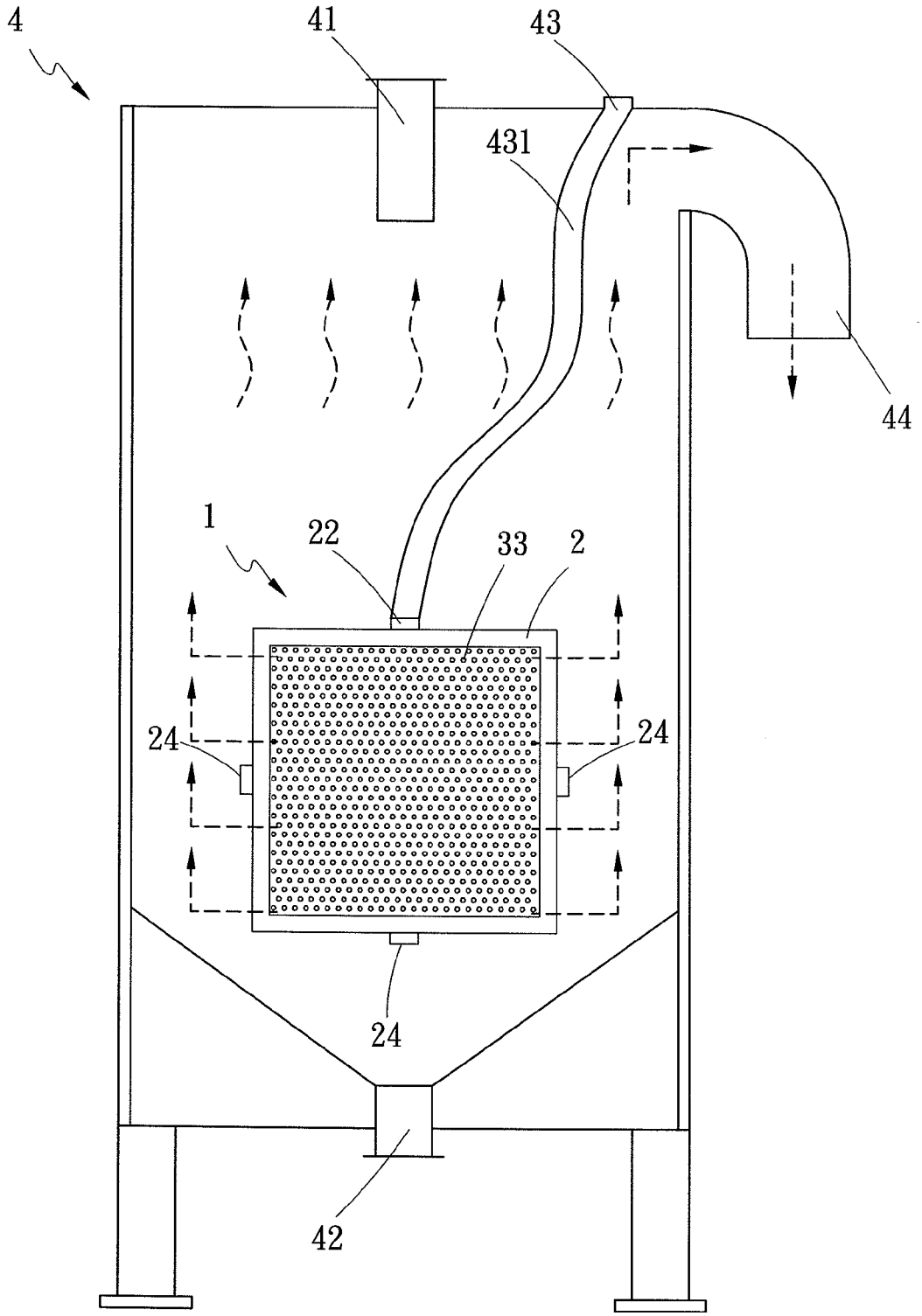
FIG. 11 is a schematic view according to FIG. 1 in a using condition.

Refer to FIG. 11 for a schematic view according to FIG. 1 in a using condition. The air inlet and outlet passage module 1 is held in a storage tank 4 which has a feeding port 41 and a discharging port 42, and a dry air inlet 43 and a damp air outlet 44 at an upper side thereof. The dry air inlet 43 has an air duct 431 coupled with the duct cap 22 at the upper end of the frame 2. Other duct caps 22 not being connected are respectively sealed by the lid 24. When dry air enters through the dry air inlet 43 and exits from the air vent 33, then the damp air in the storage tank 4 can be expelled outwards through the damp air outlet 44 quickly. The duct cap 22 coupled with the air duct 431 has a diameter area greater than the total area of the air vents 33 to achieve desirable drying effect.

Figure 12:
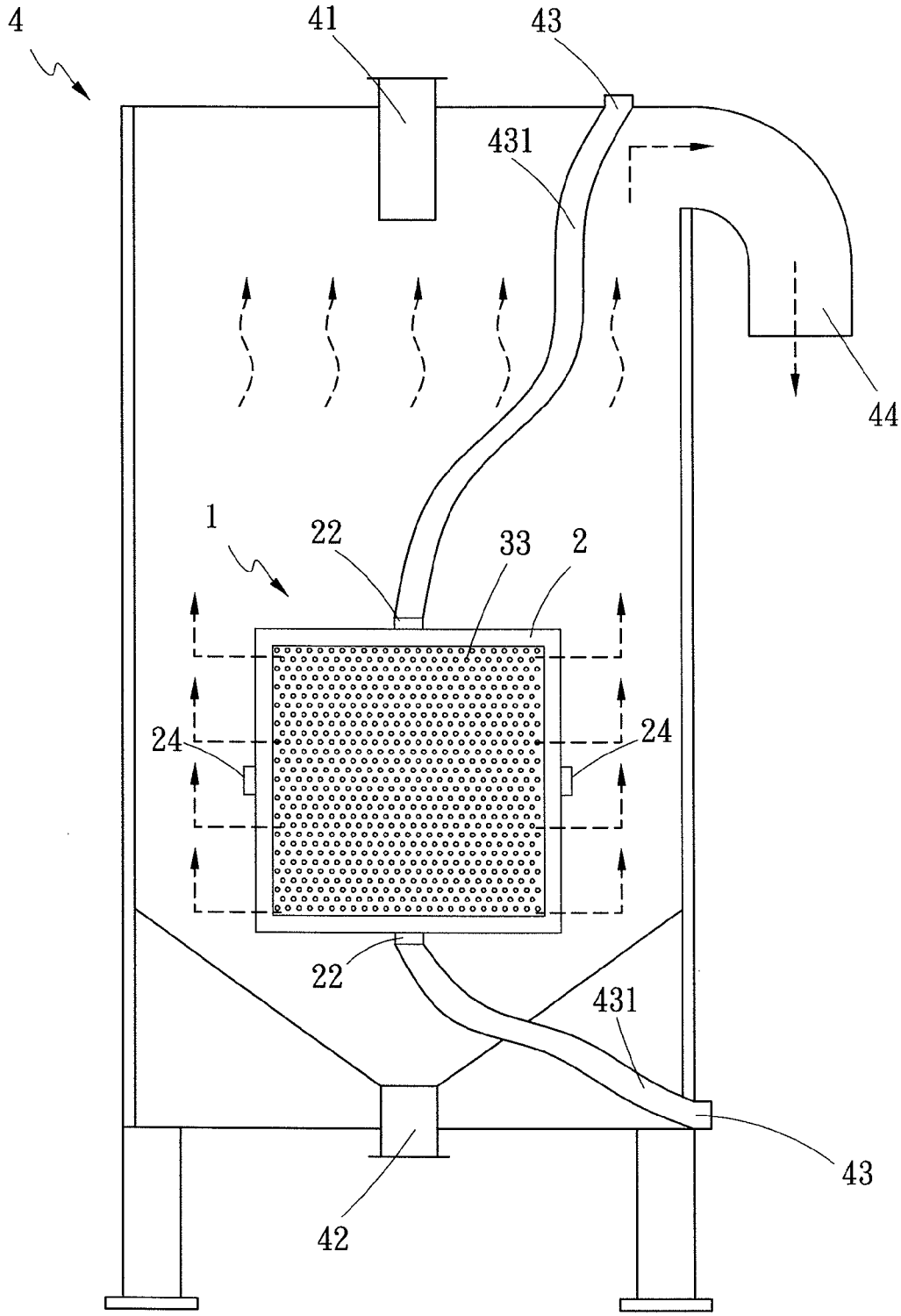
FIG. 12 is another schematic view according to FIG. 1 in a using condition.
Figure 13:
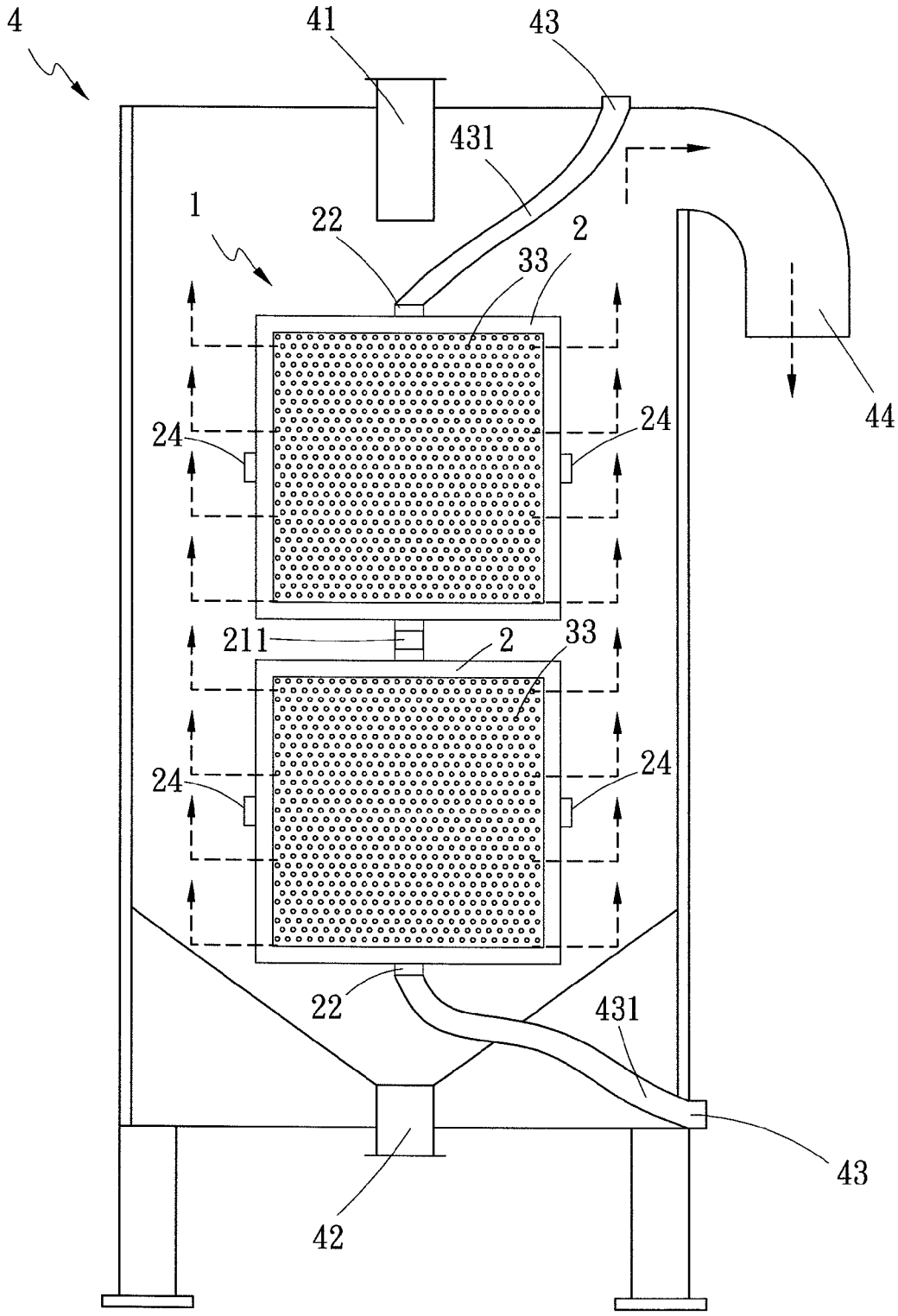
FIG. 13 is yet another schematic view according to FIG. 1 in a using condition.

Refer to FIG. 12 for another schematic view according to FIG. 1 in a using condition. The air inlet and outlet passage module 1 is held in a storage tank 4 which has a feeding port 41 and a discharging port 42, and dry air inlets 43 respectively on an upper end and a lower end, and a damp air outlet 44 on the upper end. The dry air inlet 43 has an air duct 431 coupled with a duct cap 22 respectively at the upper and lower ends of the frame 2. Other duct caps 22 not being connected are respectively sealed by a lid 24. When dry air enters through the dry air inlets 43 and exits from the air vent 33, then the damp air in the storage tank 4 can be expelled outwards through the damp air outlet 44 quickly. The duct cap 22 coupled with the air duct 431 has a diameter area greater than the total area of the air vents 33 to achieve desirable drying effect.

Refer to FIG. 13 for yet another schematic view according to FIG. 1 in a using condition. The storage tank 4 holds two air inlet and outlet passage modules 1 which are coupled through a connector 211 in a serial manner. The storage tank 4 has a feeding port 41 and a discharging port 42, and dry air inlets 43 respectively on an upper end and a lower end, and a damp air outlet 44 on the upper end. The dry air inlet 43 has an air duct 431 coupled with a duct cap 22 respectively at the upper and lower ends of the frame 2. Other duct caps 22 not being connected are respectively sealed by a lid 24. When dry air enters through the dry air inlets 43 and exits from the air vent 33, then the damp air in the storage tank 4 can be expelled outwards through the damp air outlet 44. The duct cap 22 coupled with the air duct 431 has a diameter area greater than the total area of the air vents 33 to achieve desirable drying effect.

Figure 2:
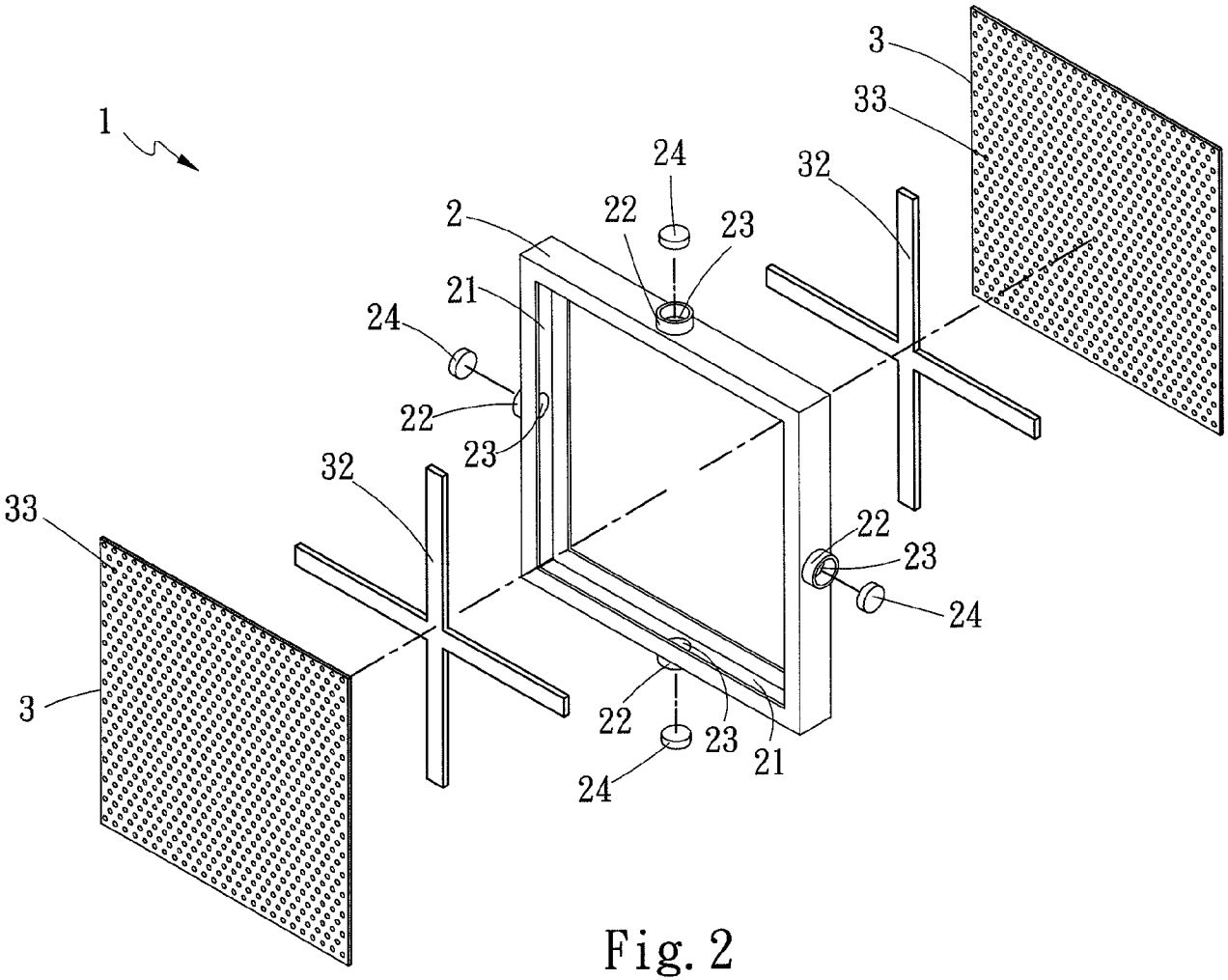
FIG. 2 is an exploded view of the invention.
Figure 3:
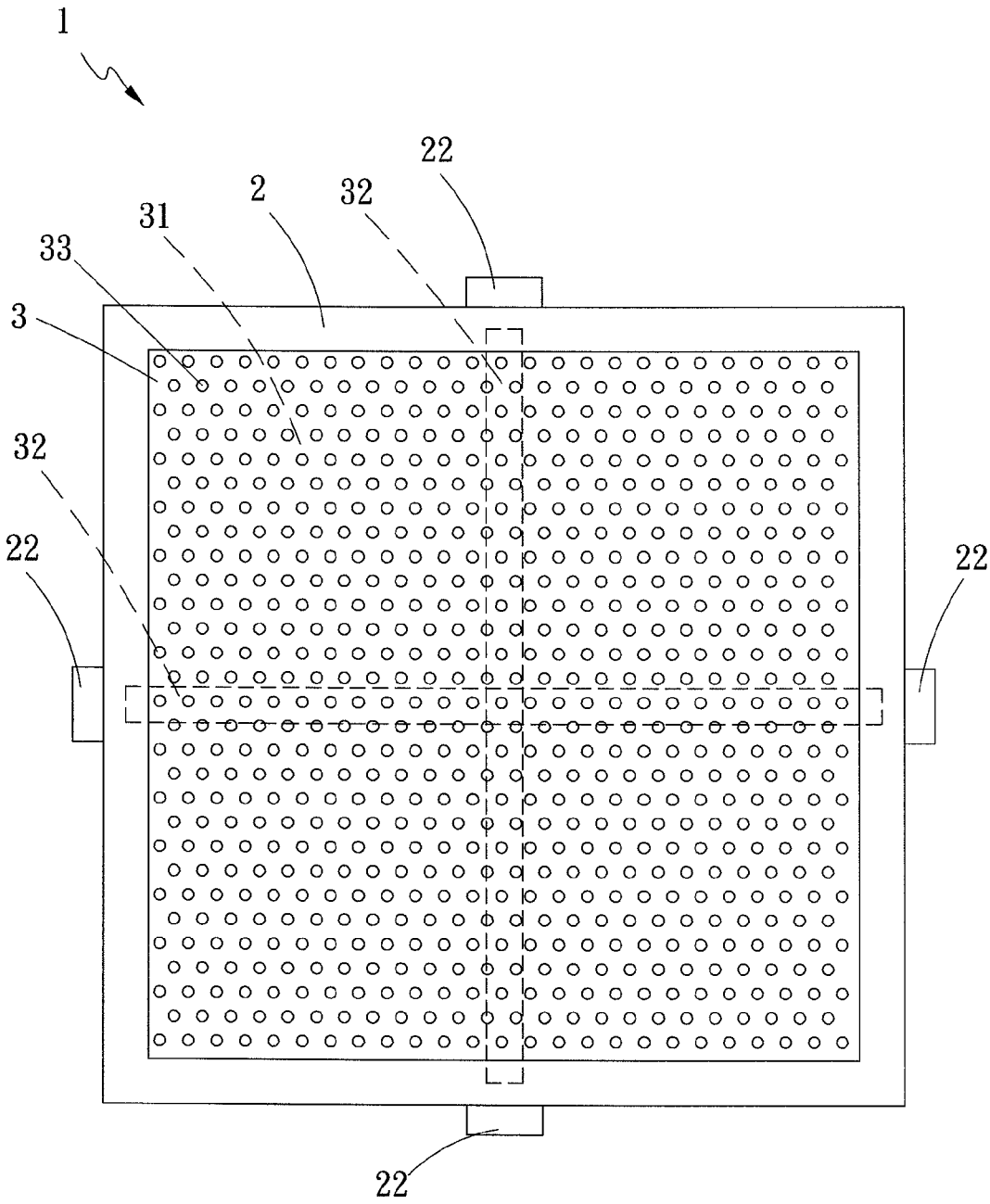
FIG. 3 is a front view of the invention.
Figure 4:
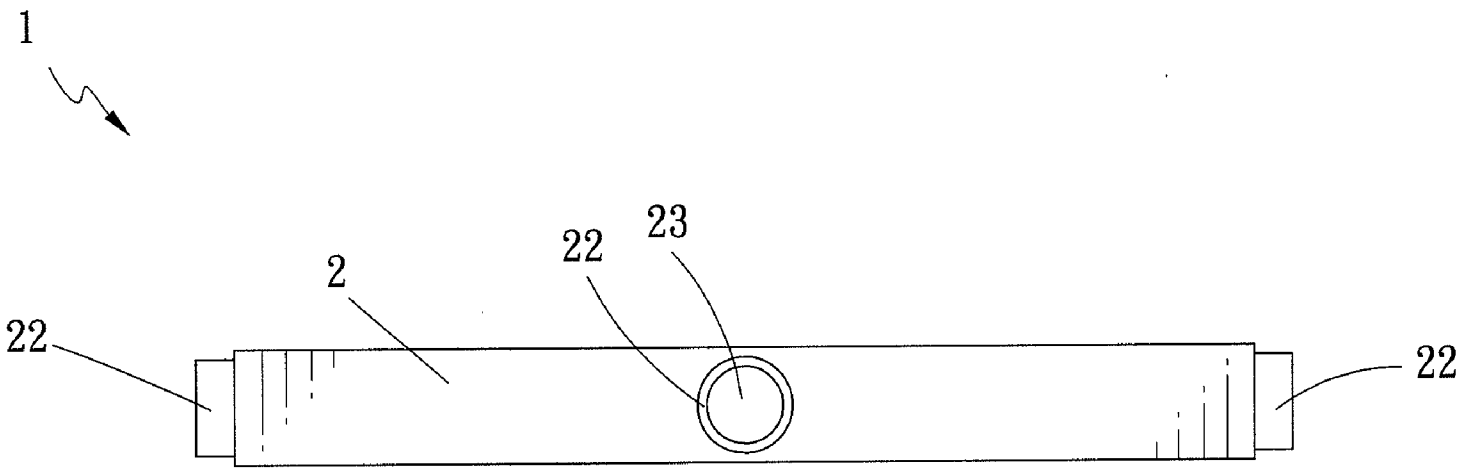
FIG. 4 is a top view of the invention.
Figure 5:
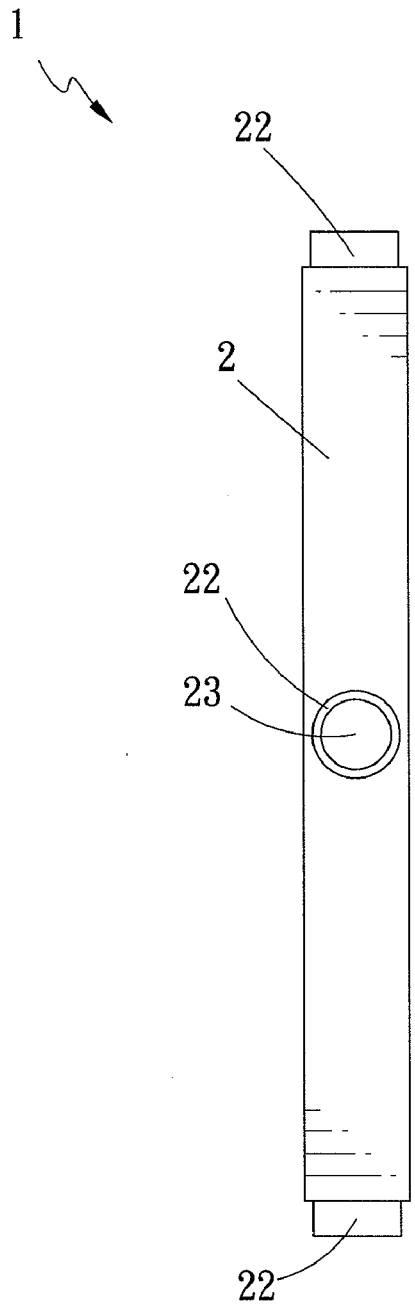
FIG. 5 is a side view of the invention.
Figure 6:
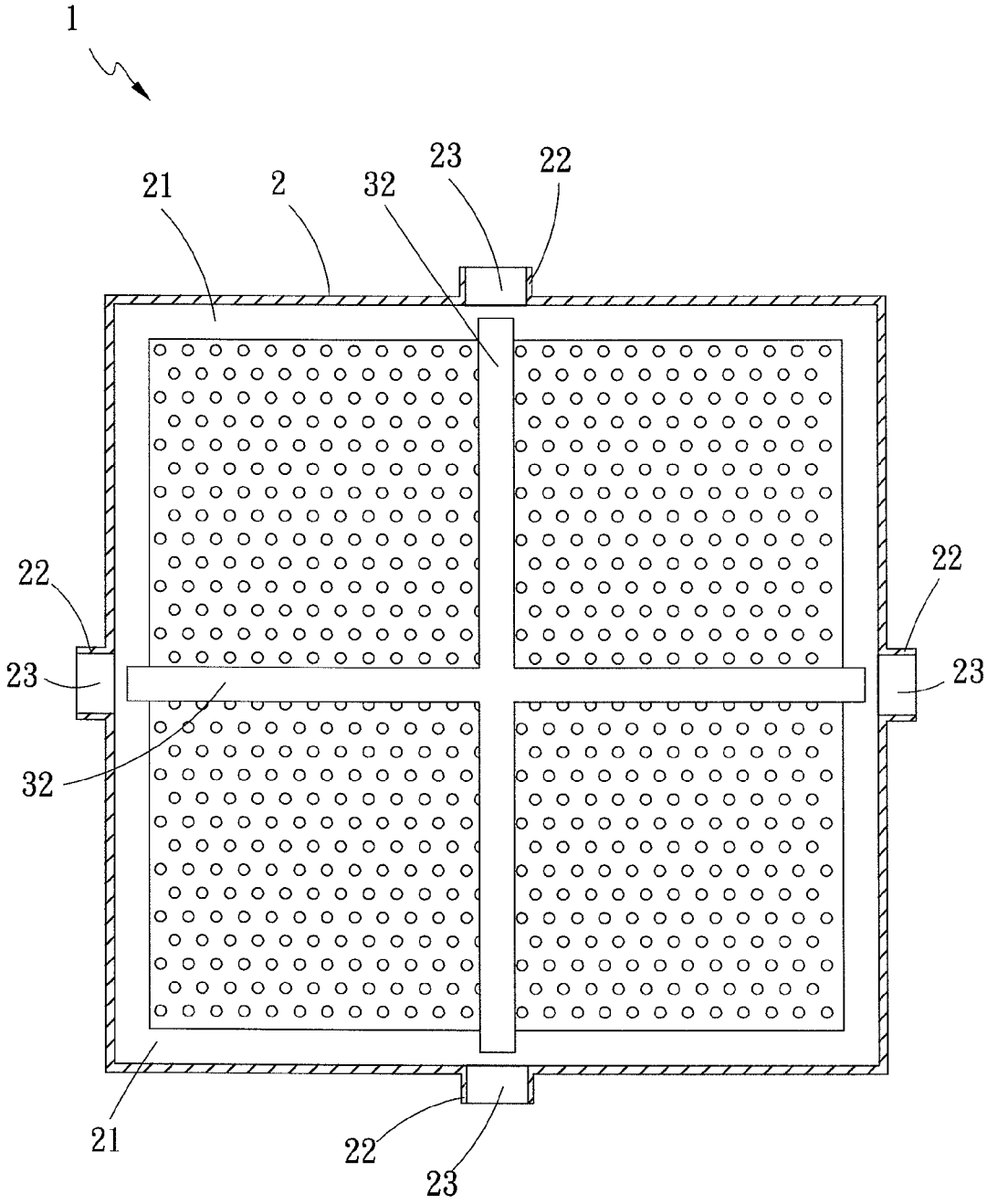
FIG. 6 is a front sectional view of the invention.
Figure 7:
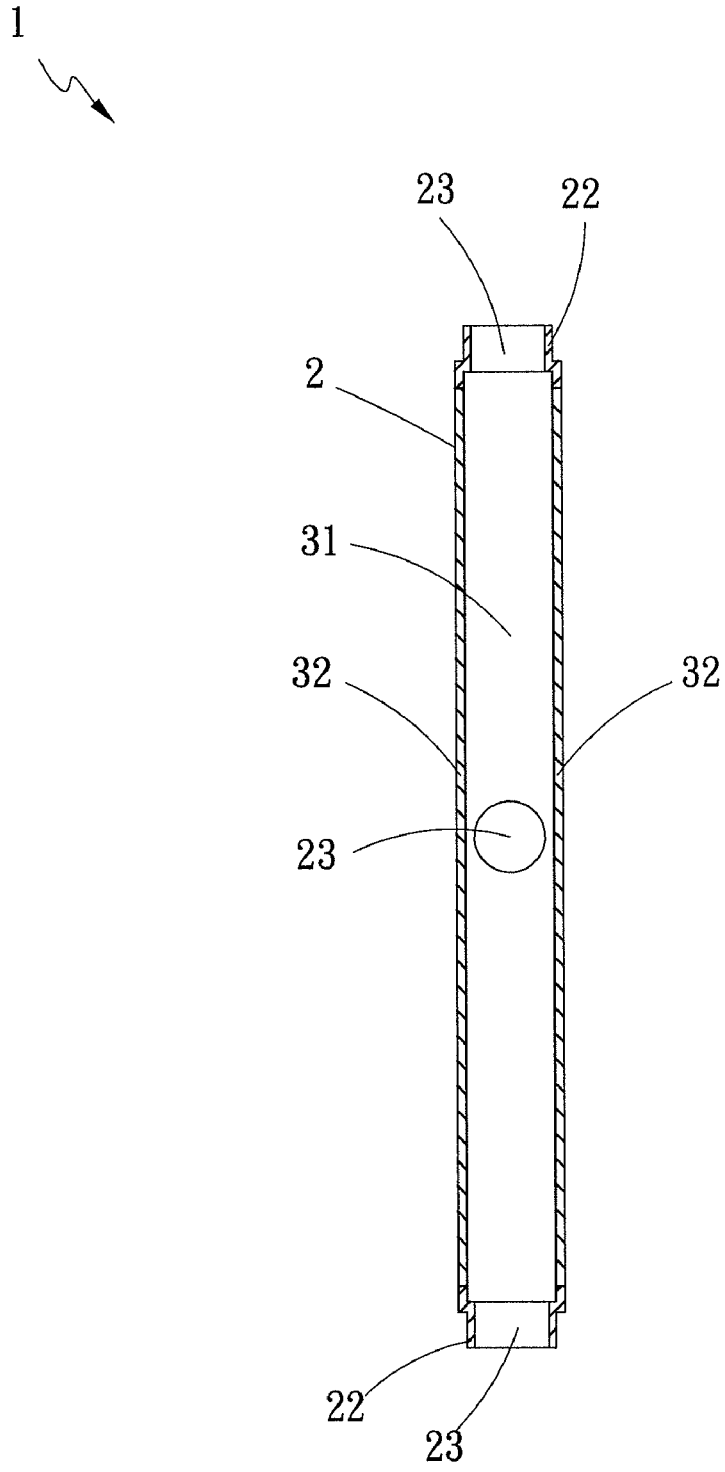
FIG. 7 is a side sectional view of the invention.
Figure 14:
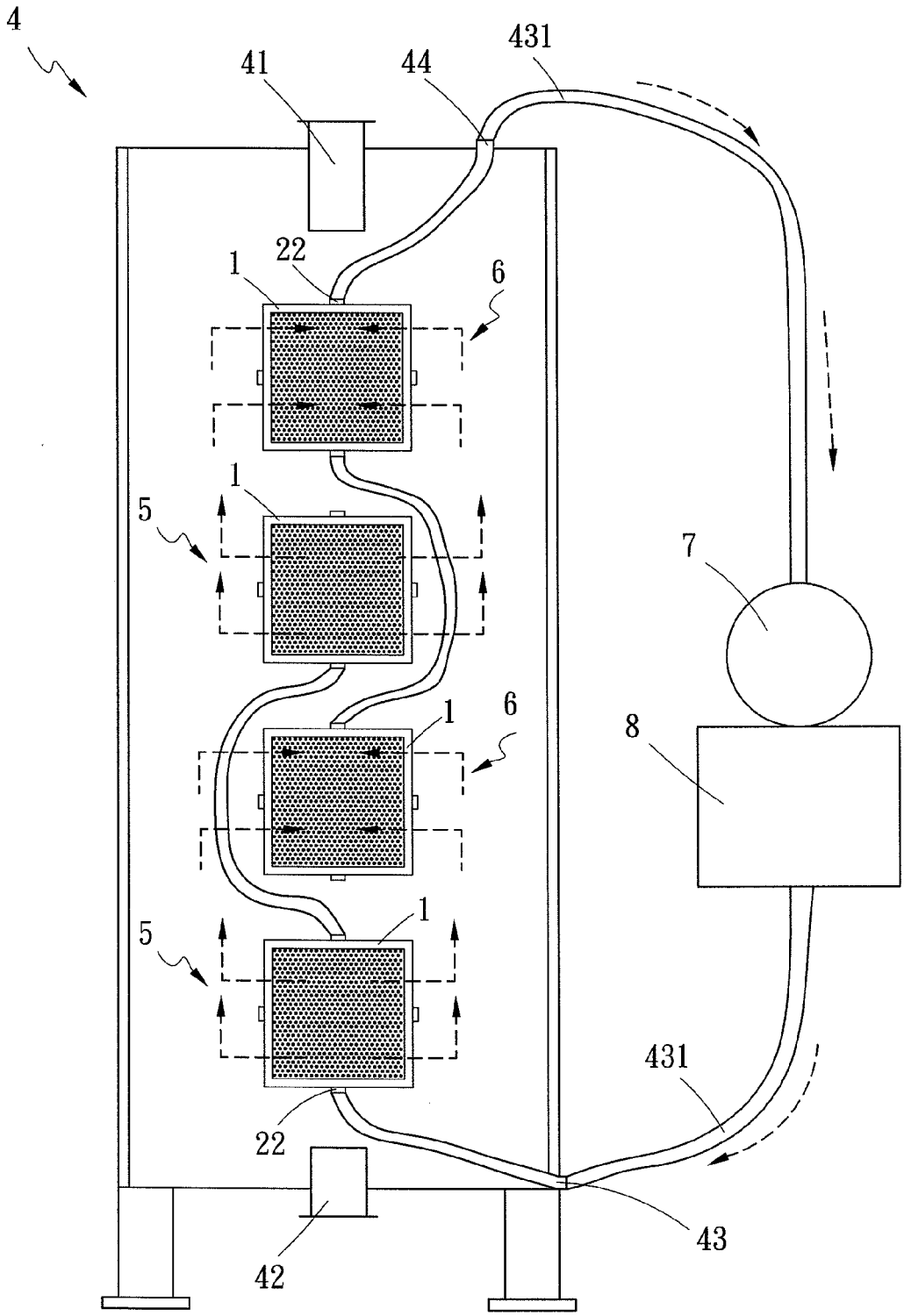
FIG. 14 is a schematic view of yet another embodiment of the invention in a using condition.
Figure 15:
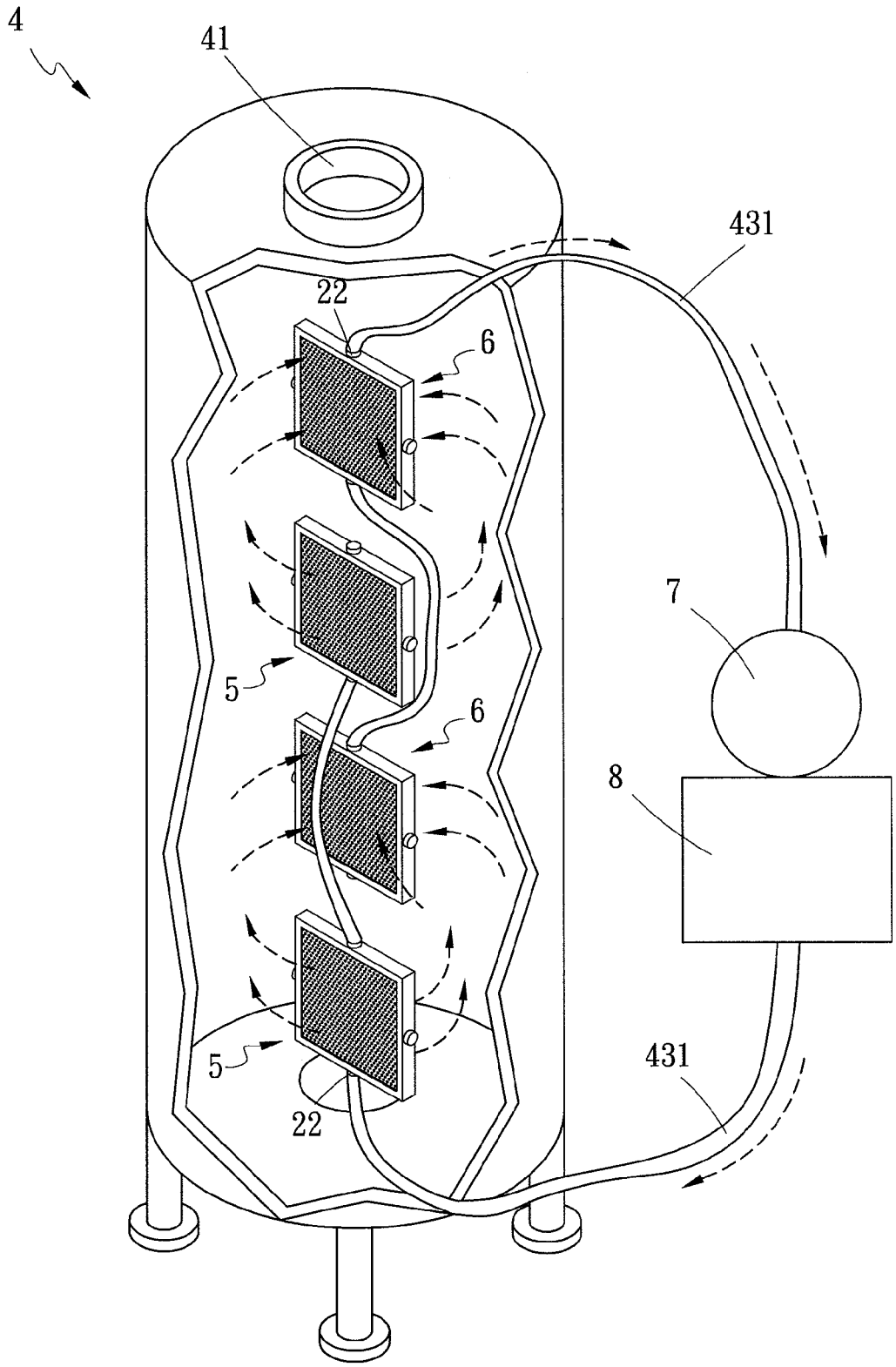
FIG. 15 is a schematic view according to FIG. 14 in a using condition.

Refer to FIGS. 2, 14 and 15 for yet another embodiment of the invention in which the storage tank 4 holds a plurality of air inlet and outlet passage modules 1 inside spaced with each other in a staggered manner. Half of the air inlet and outlet passage modules 1 are coupled to form an air inlet module 5 while other half of the air inlet and outlet passage modules 1 are coupled to form an air outlet module 6. The storage tank 4 has a feeding port 41 and a discharging port 42, and a dry air inlet 43 at the lower end and a damp air outlet 44 at an upper end. The dry air inlet 43 is coupled with a duct cap 22 at the lowest end of the air inlet module 5 through an air duct 431. The damp air outlet 44 is coupled with another duct cap 22 at the upmost end of the air outlet module 6 through another air duct 431. Other duct caps 22 not being connected are respectively sealed by a lid 24. After assembling, the air duct 431 communicating with the damp air outlet 44 can be coupled with a blower 7 which is linked to an air circulation dehumidifying system 8 which is further linked to the air duct 431 communicating with the dry air inlet 43. Then the blower 7 can quickly extract damp air in the storage tank 4 through the air outlet modules 6, and the damp air is dehumidified through the air circulation dehumidifying system 8 to become dry air and send it into the storage tank 4 again via the air duct 431 and dry air inlet 43. Thus a repetitive circulation procedure is formed to save energy, improve drying efficiency and also shorten drying time.

Figure 16:
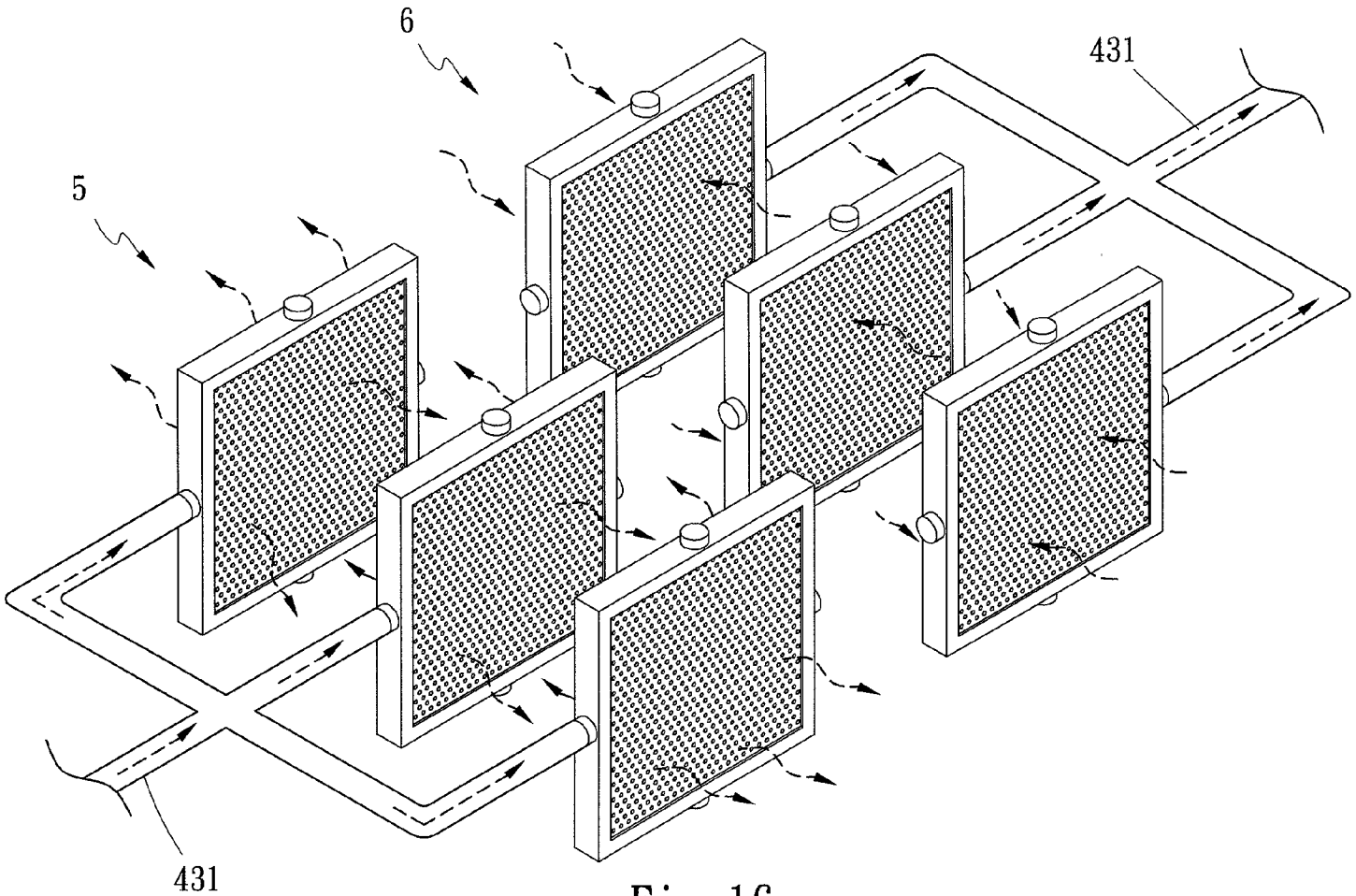
FIG. 16 is a schematic view of still another embodiment of the invention in a using condition.

Refer to FIG. 16 for still another embodiment of the invention. The piping configuration adopts the embodiments previously discussed. However, a plurality of air inlet and outlet passage modules 1 are coupled in series and parallel to form respectively an air inlet module 5 and an air outlet module 6 that are installed in a rectangular cabin of a bulk carrier to dry crops during transportation to achieve optimal preservation.

What is claimed is:

1. An air inlet and outlet passage module for desiccation formed in a cubical hollow structure, comprising:

a frame which includes a frame channel between frame sides and at least one duct cap on outer sides, the duct cap including an opening communicating with the frame channel and being coupled with an air duct such that a plurality of air inlet and outlet passage modules are coupled in series through the air duct; and two boards being located at two sides of the frame corresponding to each other to form the hollow structure including a housing space inside, each board including a plurality of air vents to facilitate air ventilation.

2. The air inlet and outlet passage module of claim 1, wherein the frame is made of metal.

3. The air inlet and outlet passage module of claim 1, wherein the housing space holds at least one reinforced member.

4. The air inlet and outlet passage module of claim 1, wherein the air duct and the air inlet and outlet passage module are selectively coupled by wedging, latching or connecting through a connector.

5. An air inlet and outlet passage module for desiccation formed in a cylindrical hollow structure, comprising:

two frames that include a frame channel formed on an inner rim thereof and at least one duct cap on an outer side, the duct cap including an opening communicating with the frame channel and being coupled with an air duct such that a plurality of air inlet and outlet passage modules are coupled in series through the air duct; and a board which bridges the two frames in an annular manner to form a housing space inside and includes a plurality of air vents to facilitate air ventilation.

6. The air inlet and outlet passage module of claim 5, wherein the two frames are made of metal.

7. The air inlet and outlet passage module of claim 5, wherein the housing space holds at least one reinforced member.

8. The air inlet and outlet passage module of claim 5, wherein the air duct and the air inlet and outlet passage module are selectively coupled by wedging, latching or connecting through a connector.

* * * * *